US005125648A

United States Patent [19]

Olschansky et al.

[11] Patent Number: 5,125,648

[45] Date of Patent: Jun. 30, 1992

[54] UPPER BODY EXERCISE SYSTEM

[75] Inventors: Brad Olschansky, Baltimore; Scott Olschansky, Towson; Raymond H. Lee, Jr., Lutherville, all of Md.

[73] Assignee: Lifeing, Inc., Pikesville, Md.

[21] Appl. No.: 582,093

[22] Filed: Sep. 14, 1990

[51] Int. Cl.[5] ..... A63B 23/02

[52] U.S. Cl. ..... 482/62; 482/51

[58] Field of Search ..... 272/73, 72, 93, 70, 272/97, 143; 135/66

[56] References Cited

U.S. PATENT DOCUMENTS

| | | | |
|---|---|---|---|
| 4,557,479 | 12/1985 | Guibert | 272/143 |
| 4,625,963 | 12/1986 | Lancellotti | 272/73 |
| 4,741,527 | 5/1988 | Nestegard | 272/73 |

*Primary Examiner*—Stephen R. Crow

*Attorney, Agent, or Firm*—Morton J. Rosenberg; David I. Klein

[57] ABSTRACT

An upper body exercise system (10) is provided for exercising the upper body (16) of a user (12) in conjunction with a lower body exercise mechanism (14). The upper body exercise system includes a foot actuated mechanism (22) which is displaced by the user (12) and has a substantially longitudinally directed axis (31). Handle mechanism (30) is included and adapted to be grasped by the user (12) and is displaceably coupled to the foot actuated mechanism (22) and includes a central axis (36). Further, the exercise system (10) provides for an upper body exercise system coupling mechanism (40) which allows for the combination of rotation of the handle mechanism (30) about the central axis (36) and a rotation of the handle mechanism (30) about the longitudinally directed axis (31) of the foot actuated mechanism (22). Mechanism (10) further allows for pivotal displacement of the handle mechanism (30) in a plane coincident with a plane defined by the foot actuated mechanism longitudinal axis (31) and the handle mechanism central axis (36). In this manner, there is provided an upper body exercising system which provides the user with a wide variety of orientations of the handle mechanism (30) during exercise to exercise differing muscle groups.

19 Claims, 3 Drawing Sheets

UPPER BODY EXERCISE SYSTEM

BACKGROUND OF THE INVENTION

1. Field of the Invention

This invention pertains to exercising systems. In particular, this invention relates to an upper body exercise system for use and in conjunction with a lower body exercising mechanism. This invention pertains to an exercising system where the user has the capability of exercising upper body muscle groups in a wide variety of ways. More in particular, this invention provides for an exercising system which allows the user to manipulate and orient handles in a wide variety of patterns. Still further, this invention relates to an upper body exercising system which allows the user to rotate the handle members about three axes of rotation during a particular exercise. Further, this invention directs itself to an upper body exercising system which may be coupled to a lower body exercising system such as a stationary bicycle wherein the upper body mechanism may be used to rotate the pedal members of the stationary bicycle. Further, this invention directs itself to an upper body exercising system which may be placed in predetermined orientations with respect to a lower body exercising mechanism to allow force loading on differing muscle groups responsive to specific exercise conditions.

2. Prior Art

Upper and lower body exercising systems are known in the art. Further, lower body exercising systems such as stationary bicycles for exercising the muscles of legs of a user are well-known in the art. Still further, exercise systems for the lower body are known which include hand or arm actuation to apply load forces for exercising purposes.

The closest prior art systems known to Applicant include U.S. Pat. No. 4,741,527 which is directed to an upper body exerciser system for a stationary bicycle. Such prior art system does provide for a handle mechanism attached to the pedals of a stationary bicycle. However, such prior art system does not provide for the coupling elements of the upper body mechanism of the subject invention to the lower body exercising system and does not allow for the wide variation and predetermined orientations of the handle systems of the subject invention concept. Such prior art systems do not allow for universal rotation of the handle bar members which impedes the exercising of certain muscle groups.

Other prior art systems such as U.S. Pat. No. 4,451,033 are directed to upper body exercise systems for stationary bicycles. However, in such prior art systems, handles are displaceable only in a singular plane which does not allow the user to vary the force actuating plane on the pedals of the bicycle system.

Thus, such prior art systems do not provide for a variation of muscle combination sets to actuate the pedals of a stationary bicycle and provide upper body exercising utilizing differing muscle set combinations. Still further, prior art systems as exemplified by U.S. Pat. No. 4,451,033 do not allow the user to vary the force loading on the user's upper body as a function of plane variation of the handle members when taken with respect to the pedals of a lower body exercising system.

Other prior art systems known to Applicant include U.S. Pat. Nos. 3,681,111; 4,188,030; 2,261,355; 4,509,742; and, 3,587,319. However, in such prior art systems, handlebar mechanisms do not allow for predetermined orientations as provided in the subject invention concept. Other prior art known to Applicant includes French Patent #1,474,840 and West German Patent #2,814,756.

In other prior art systems where a stationary bicycle or other lower body exercising system is used, the upper body exercising mechanism is not releasably coupled from the stationary bicycle system to provide an independent driving force. Additionally, such prior art exercising systems are generally directed to an arm drive system which is forward of the seated user and is coupled to the force resisting member through a complicated mechanical coupling system.

In such prior art systems, the mechanical linkages are generally complicated which increases the labor costs in construction, and specifically do not provide for the wide range of orientations of the upper body exercising device in order to exercise differing upper body muscle groups of the user.

SUMMARY OF THE INVENTION

An upper body exercise system for exercising the upper body of a user in conjunction with a lower body exercise mechanism. The upper body exercise system includes a foot actuated mechanism for being displaced by the user. The foot actuated mechanism has a longitudinally directed axis. A handle mechanism is adapted to be grasped by the user and is displaceably coupled to the foot actuated mechanism with the handle mechanism having a central axis. A mechanism is provided for coupling the handle mechanism to the foot actuated mechanism to allow for the combination of the rotation of the handle mechanism about the central axis, as well as a rotation of the handle mechanism about the longitudinally directed axis of the foot actuated mechanism. Still further, a rotative displacement of the handle mechanism is provided in a plane coincident with a plane defined by the foot actuated mechanism's longitudinal axis and the handle mechanism's central axis.

DESCRIPTION OF THE PREFERRED EMBODIMENTS

Figures 2, 3:
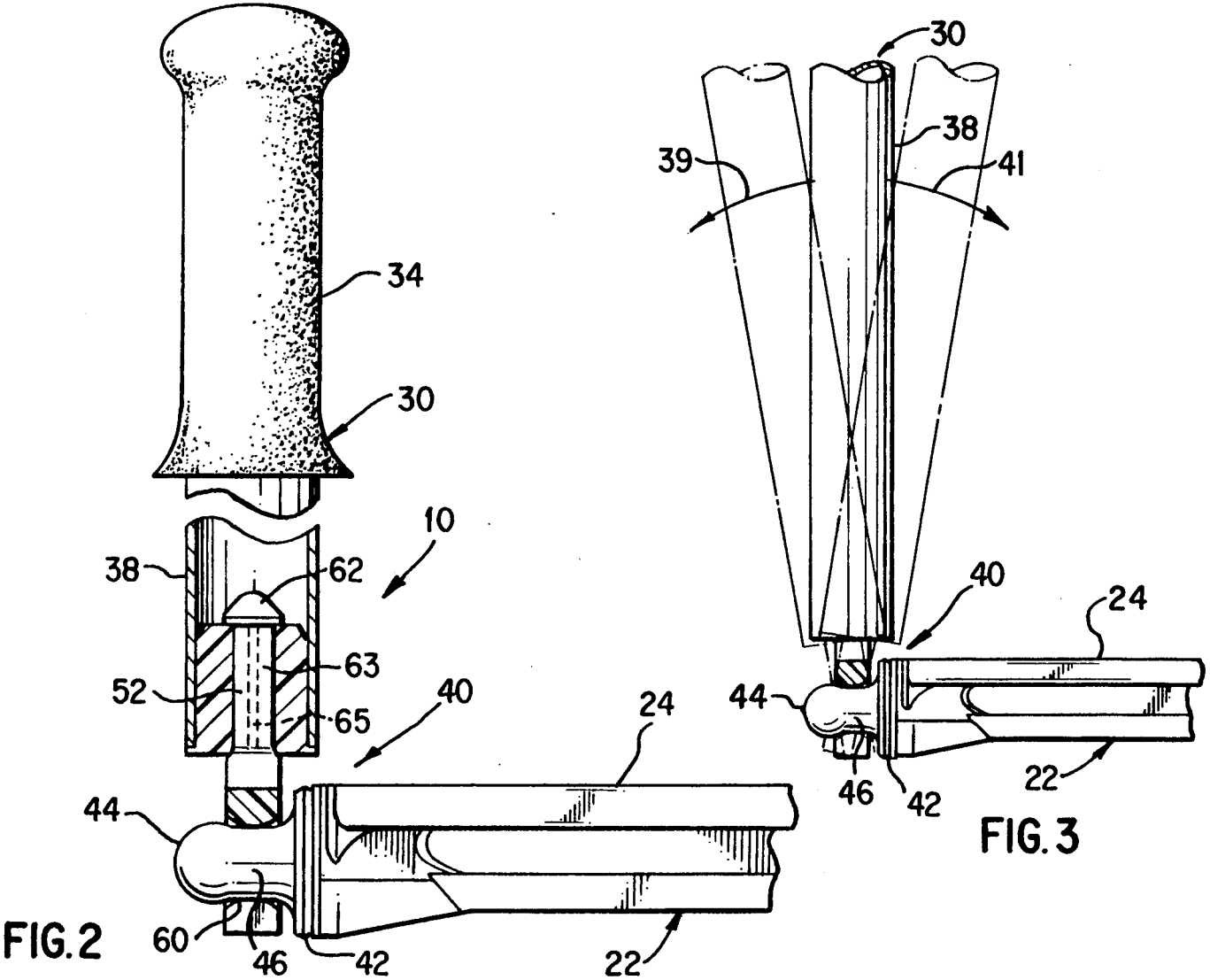
FIG. 2 is a cross-sectional view of the upper body mechanism system coupling between a pedal and a handle.
FIG. 3 is a cut-away sectional view of the coupling mechanism of the upper body exercise system showing rotation of the handle mechanism in a plane coincident with a plane defined by a longitudinal axis of the pedal mechanism and a central axis of the handle mechanism; and, FIG. 4 is a perspective view of the upper body exercise system in use and in combination with a stationary bicycle.
Figure 4:
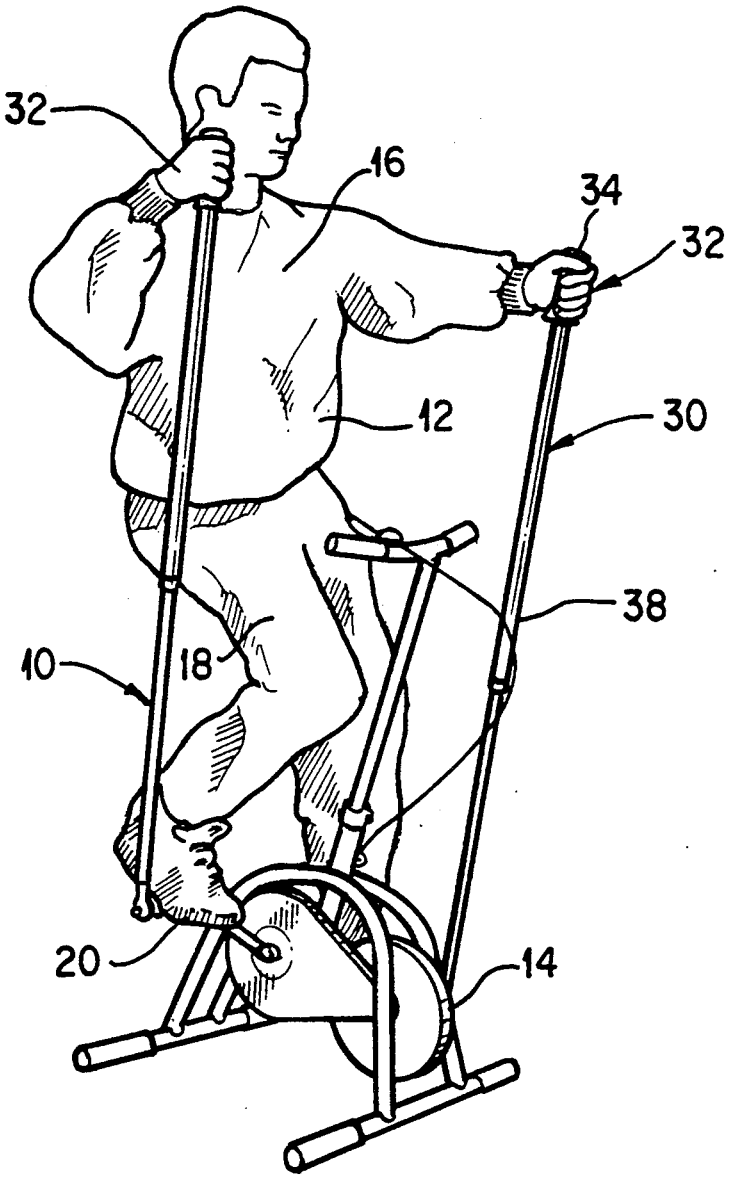

Referring now to FIGS. 1–4, there is shown upper body exercise system 10 for exercising the upper body portion 16 of user 12 in conjunction with lower body exercise mechanism 14 which may be a stationary bicycle or some other lower body operated system for exercising lower body portion 18 of user 12. As will be seen in following paragraphs, upper body exercise system 10 is to be used in conjunction and cooperation with lower body exercise mechanism 14. Lower body mechanism 14 as shown in FIG. 4 is in the overall structure of a stationary bicycle, however, the particular construction and form of lower body mechanism 14 is unimportant to the inventive concept as herein described, with the exception of lower body mechanism 14 being adaptable for interface and connection to upper body exercise system 10. As shown, lower body mechanism 14 is adapted to be forcedly interfaced with feet 20 of user 12 to provide some force resistance and exercise lower body portion 18 of user 12.

Upper body exercise system 10 may be used in conjunction with a wide variety of lower body exercise systems such as, but not limited to, track type devices such as conveyor mechanisms. In such instances, the related components of upper body exercise system 10 remain essentially the same as will be discussed in following paragraphs, however, minor modifications may be made to interfacing connections.

Upper body exercise system 10 includes foot actuated mechanism 22 for being displaced by user feet 20. In the embodiment shown in FIg. 4, foot actuated mechanism 22 is a pedal member having upper surface 24 for contacting an interfacing portion of the user's feet 20. In the embodiment shown in FIG. 4, lower body mechanism 14 takes the form of a stationary bicycle which can exercise lower body portion 18 of user 12 by providing resistance force through dynamometer loading or some like technique, not important to the inventive concept as herein described. In this type of environment, upper body exercise system 10 may be used to rotate foot actuated mechanism 22. This provides for a restraining force which is acted upon by upper body muscles of user 12. By varying the angle of handle mechanism 30, user 12 has the ability to accommodate a number of upper body muscle groups during an exercise period.

With relation to the connective features of lower body mechanism 14 to upper body exercise system 10, foot actuated mechanism 22 includes end section 26 having foot actuated passage or opening 28 formed within end section 26. Foot actuated mechanism passage 28 forms an end chamber whose purposes will be described in following paragraphs. Foot actuated mechanism passage 28 is generally formed below foot actuated mechanism upper surface 24 in order that upper surface 24 be somewhat planar in overall contour to allow interface with the user's feet 20. Foot actuated mechanism or pedal 22 may be formed of plastic, metal, rubber or some like composition not important to the inventive concept as herein described, with the exception that foot actuated mechanism 22 has sufficient structural integrity to accommodate the applied force loading during exercise.

Passage 28 formed in end section 26 is generally circular in cross-sectional contour, however, such overall contour is not important to the inventive concept of the subject invention. Additionally, longitudinally directed axis 30 defines a longitudinal direction for foot actuated mechanism 22. Handle mechanism 30 is adapted to be grasped by user hands 32 as shown in FIG. 4. Handle mechanism 30 includes hand grip member 34 which may have a textured covering to increase the frictional contact between user hands 32 and handle mechanism 30. In general, hand grip 34 is fixedly attached to the top of handle mechanism 30 by adhesive bonding, force fit interface or some like technique. Hand grip member may be formed of a plastic or rubber composition well-known in the art. Additionally, hand grip member 34 may be contoured to accommodate user hands 32. Handle mechanism 30 is displaceably coupled to foot actuated mechanism 22, as is shown in FIGS. 2–4. Additionally, handle mechanism 30 defines central axis line 36 which generally extends central to the geometric contour of pole member 38. Pole member 38 may be formed in one-piece formation, or may be formed of sections coupled to each other which may be telescopically received, one within the other.

Figure 1:
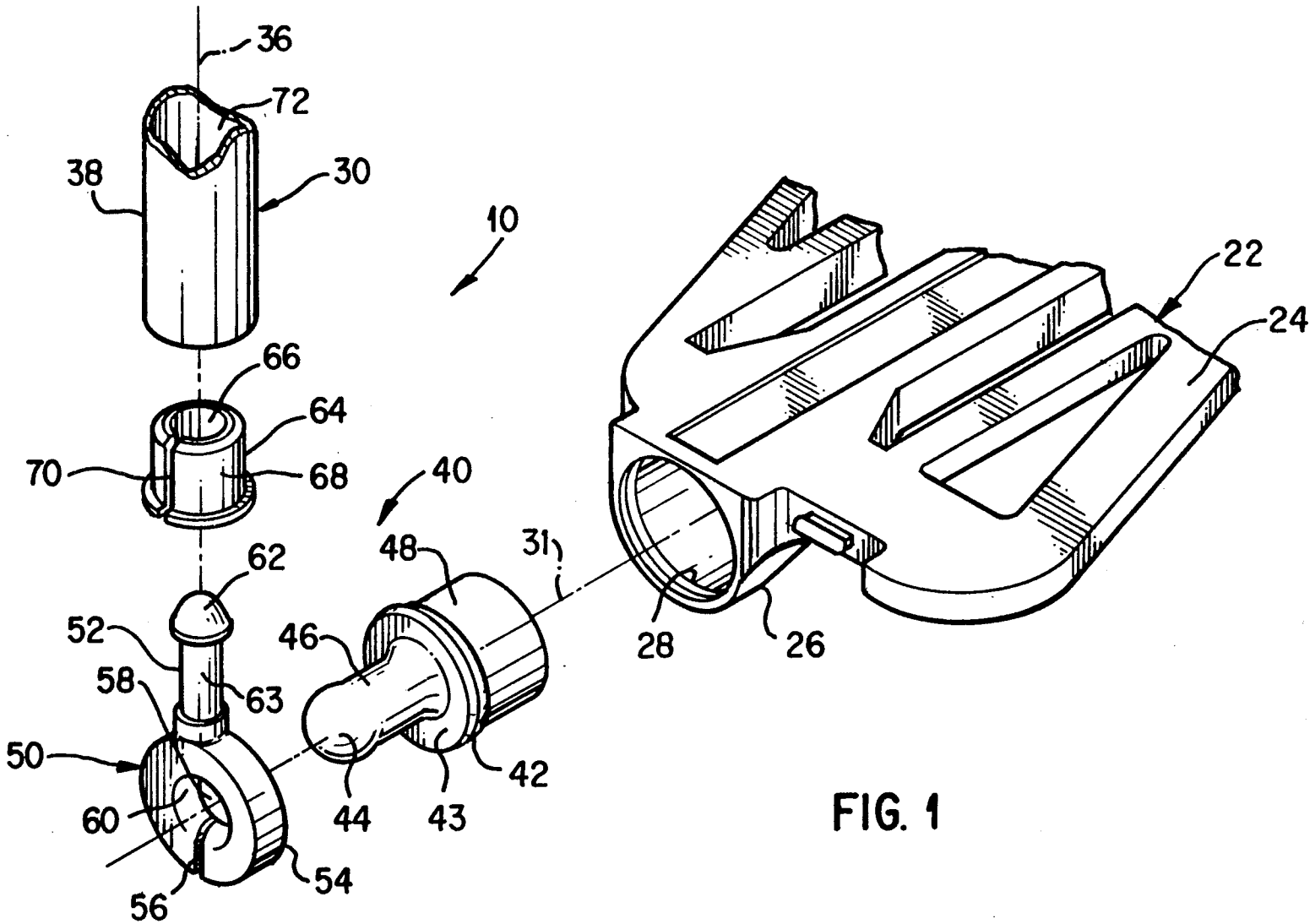
FIG. 1 is an exploded cut-away view of the coupling mechanism for the upper body exercise system.

Upper body exercise system coupling mechanism 40 clearly shown in FIGS. 1–3 couples handle mechanism 30 to foot actuated mechanism 22 to allow rotation of handle mechanism 30 about central axis directional line 36, as well as rotation of handle mechanism 30 about substantially longitudinally directed axis line 31 of foot actuated mechanism 22. Additionally, upper body exercise system 10 allows for rotative displacement of handle mechanism 30 in a plane which is coincident with a plane defined by foot actuated mechanism longitudinal axis 31 and handle mechanism central axis 36, as is clearly shown in FIG. 3 where such rotative displacement is depicted in phantom line drawing. In this manner, user 12 is essentially provided with a universal rotative displacement mechanism having an infinite number of orientation positions to permit exercising of different upper body muscles.

Upper body exercise system coupling mechanism 40 includes plug member 42 which is adapted to be secured to foot actuated mechanism 22. Plug member 42 includes bulbous end portion 44 having a predetermined maximum cross-sectional diameter. Additionally, plug member 42 includes plug member central portion 46 of a cross-sectional diameter less than the maximum cross-sectional diameter of bulbous end portion 44. Plug member central portion 46 has an extended length in the longitudinal direction defined by axis line 31. The extended length is to provide a surface length whereby collar mechanism 50 may be captured between bulbous end portion 44 and surface 43 while being given sufficient tolerance to rock back and forth, as shown in FIG. 3. Plug member end section 48 shown in FIG. 1 is formed in generally one-piece formation with bulbous end portion 44 and plug member central portion 46. Plug member end section 48 is adapted to be inserted within foot actuated mechanism passage 28. Plug member end section 48 may have a cross-sectional diameter substantially equal to, but slightly greater than, foot actuated mechanism passage 28 in order to allow a force fit therebetween.

Alternatively, plug member end section 48 may be threaded in order to allow securement between plug member 42 and foot actuated mechanism 22. The important concept being that plug member 42 be secured to foot actuated mechanism 22 through fixed engagement of plug member 42 with pedal or foot actuated mechanism 22. Plug member 42 may be formed of a variety of materials such as plastic, metal, or some like composition, not important to the inventive concept as herein described, with the exception that plug member 42 be formed of a composition which would allow secure interface and coupling to foot actuated mechanism 22.

Upper body exercise system coupling mechanism 40 further includes collar mechanism 50 which is rotatively coupled to plug member 42. Collar mechanism 50 has extension lug member 52 fixedly secured thereto, as is clearly seen in FIG. 1. Collar mechanism 50 further includes annularly contoured disk member 54 having a through slot 56 to allow some deformation of disk member 54 upon insertion forces to be described in following paragraphs. Disk member 54 includes through opening 58 defining inner wall 60, more clearly shown in FIGS. 1 and 2. As seen in FIG. 2 and 3,disk member inner wall 60 is arcuately formed in a direction substantially coincident with longitudinally directed axis line 31. Disk member inner wall 60 defines a cross-sectional diameter of through opening 58 which is not constant in the direction of axis line 31. The smallest diameter of through opening 58 is seen to be less than the cross-sectional diameter of bulbous end portion 44 of plug member 42. However, the smallest diameter of through opening 58 is substantially equal to, and possibly slightly greater than, plug member central portion 46.

The arcuate contour of disk member inner wall 60 allows for pole member 38 to be rocked or reversibly displaced in a direction defined by longitudinal axis line 31. The rotative displacement of handle mechanism 30 due to this interface between disk member inner wall 60 and plug member central portion 46 is seen in FIG. 3 and depicted by directional arrows 39 and 41. In this manner, central portion 46 of plug member 42 acts as a fulcrum and base surface about which pole member 38 is reversibly rotated.

In this manner, user 12 may extend his or her arms to provide differing forces for various muscle groups. Additionally, due to the fact that the smallest diameter defined by disk member inner wall 60 is equal to or slightly greater than the cross-sectional diameter of plug member central portion 46, pole member 38 may be rotatively displaced in a plane substantially perpendicular to longitudinally directed axis line 31. In this manner, user 12 is given the ability to further extend his or her arms in varying directions to provide variations in the forces applied to differing muscle groups.

In order to provide resilient deformation of collar mechanism 50 allowing passage therethrough of bulbous end portion 44, through slot 56 is provided through disk member 54. Once the arms of disk member 54 have been pushed apart, they are free to resume their normal positioning in adjacent juxtaposition with each other. Thus, once bulbous end portion 44 has been pushed through opening 58, collar mechanism 50 is free to rotate about longitudinally directed axis 31. Additionally, as previously described, a rocking motion can be accomplished between collar mechanism 50 due to the arcuately directed inner wall 60 contact with plub member central portion 46, as has hereinbefore been described. Disk member 54 may be formed of a plastic composition or some like material which would allow for reversible deformation upon insert of bulbous end portion 44.

As clearly seen in FIGS. 1 and 2, lug extension member 52 extends in a radial direction from disk member 54 for at least partial insert into handle mechanism 30. Lug extension member 52 is fixedly secured to an outer side wall member of disk member 54 and may be formed in one piece formation therewith. Lug extension member 52 includes lug end portion 62 having a diameter at least in one section thereof greater than a diameter of lug extension member central portion 63. Lug extension member 52 may take the overall crosss-sectional contour of an arrow or prong-like member.

Lug extension member 52, as has been described, may be formed in one piece formation with disk member 54 through molding or some like technique. However, extension member 52 may be formed of separate components secured each to the other. In such an instance, lug end portion 62 may be fixedly secured to central portion 63 or alternately be accommodated with a bolt like member 65, securing end portion 62 to disk member 54 directly.

Upper body exercise system coupling mechanism 40 further includes bushing member 64 having an overall cylindrical contour and defining through opening 66 of predetermined diameter. Bushing member 64 includes side wall 68 having a through slot 70 formed therethrough. In effect, bushing member 64 is a member commonly referred to as a split bushing. Bushing through opening 66 has a diameter which is greater than the diameter of central lug portion 63, but less than the largest diameter of lug end portion 62. Additionally, the external diameter of split bushing member 64 is slightly greater than opening 72 of handle mechanisn 30.

In this manner, lug extension member 52 may be forced through bushing through opening 66 with bushing 64 being deformed through bushing through slot 70 to accommodate passage therethrough of lug extension member 52. Once lug extension member 52 has passed through opening 66, lug end portion 62 may capture bushing member 64, as shown in FIG. 2. The combination of collar mechanism 50 and bushing 64 may be force-fitted into opening 72 to secure collar mechanism 50 to handle mechanism 30. The diameter of lug central portion 63 is less than the internal diameter of bushing through opening 66 and thus, hand grip member 34 and pole member 38 may be rotated at the discretion of the user about central axis line 36. Split bushing member 64 allows for resilient compressibility for insert into internal passage 72 of handle mechanism 30.

As hereinbefore described, upper body exercise system 10 in combination with lower body exercise system 14, allows a user to exercise his or her arms, legs and combinations thereof, dependent upon whether lower body exercise system 16 or upper body exercise system 10 are being force actuated by the user. Additionally, upper body exercise system 10 allows the user to provide for a substantially infinite number of displacements of handle mechanism 30 in relation to lower body mechanism 14 and exercise differing groups of muscles.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit of scope of the invention as defined in the appended Claims.

What is claimed is:

1. An upper body exercise system for exercising the upper body of a user in conjunction with a lower body exercise mechanism, comprising:

(a) foot actuated means for being displaced by said user, said foot actuated means having a substantially longitudinally directed axis;

(b) handle means adapted to the grasped by said user and displaceably coupled to said foot actuated means, said handle means having a central axis;

(c) means for coupling said handle means to said foot actuated means for (1) rotation of said handle means about said central axis, (2) rotation of said handle means about said substantially longitudinally directed axis of said foot actuated means; and, (3) pivotal displacement of said handle means in a plane coincident with a plane defined by said foot actuated means longitudinal axis and said handle means central axis; thereby varying the relative angle between the said longitudinal axis an said central axis; and, wherein said means for coupling includes a plug member fixedly secured to said foot actuated means; collar means rotatively coupled to said plug member, said collar means having an extension lug member fixedly secured thereto; and, means for rotatively coupling said collar means to said handle means.

2. The upper body exercise system as recited in claim 1 where said collar means includes an annularly contoured disk member having a through opening defining an inner wall of said annularly contoured disk member, said annularly contoured disk member having a through slot formed therethrough.

3. The upper body exercise system as recited in claim 2 where said inner wall of said disk member is arcuately formed in a direction substantially coincident with said longitudinally directed axis.

4. The upper body exercise system as recited in claim 2 where said extension lug member extends in a radial direction from said disk member for at least partial insertion into said handle means.

5. The upper body exercise system as recited in claim 4 where said extension lug member includes an end portion having an end diameter greater than a central portion diameter.

6. The upper body exercise system as recited in claim 5 where said extension lug member is arrow like in contour.

7. The upper body exercise system as recited in claim 5 where said means for rotatively coupling said collar means to said handle means includes a bushing member having a cylindrical contour, said bushing member having a through opening of predetermined diameter.

8. The upper body exercise system as recited in claim 7 where said bushing member includes a bushing sidewall, said sidewall having a through slot formed therethrough.

9. The upper body exercise system as recited in claim 7 where said bushing through opening diameter is greater than said lug member central portion diameter and less than said lug member end portion diameter.

10. The upper body exercise system as recited in claim 9 where said bushing member includes an inner sidewall for contiguously interfacing with said central portion of said lug member.

11. The upper body exercise system as recited in claim 10 where said bushing member is rotatively displaceable with respect to said collar means about said central axis of said handle means.

12. The upper body exercise system as recited in claim 9 where said bushing member is force fit within said handle means for fixed coupling thereto.

13. The upper body exercise system as recited in claim 9 where said handle means includes a rod member having an internal passage of predetermined diameter for insert of said bushing member.

14. The upper body exercise system as recited in claim 13 where said bushing member is resiliently compressible for insertion into said internal passage of said handle means.

15. The upper body exercise system as recited in claim 14 where said plug member includes a bulbous end portion of cross-sectional diameter greater than an inner wall diameter of said annularly contoured disk member.

16. The upper body exercise system as recited in claim 15 where said annularly contoured disk member is resiliently expansible for passage therethrough of said bulbous end portion of said plug member.

17. The upper body exercise system as recited in claim 16 where said plug member includes a central portion having a diameter less than said through opening diameter of said disk member, said arcuate inner wall of said disk member for contiguously interfacing with said plug member central portion.

18. The upper body exercise system as recited in claim 15 where said plug member includes an end portion adapted to be force fit into an opening formed in said foot actuated means.

19. The upper body exercise system as recited in claim 18 where said foot actuated means is a pedal member.

* * * * *